United States Patent [19]

Altherr

[11] Patent Number: 4,863,045

[45] Date of Patent: Sep. 5, 1989

[54] ROTARY RAILWAY DRAWBAR COUPLER

[75] Inventor: Russell G. Altherr, Munster, Ind.

[73] Assignee: AMSTED Industries Incorporated, Chicago, Ill.

[21] Appl. No.: 185,878

[22] Filed: Apr. 25, 1988

[51] Int. Cl.[4] ..... B61G 7/06

[52] U.S. Cl. ..... 213/78; 213/62 A; 213/97; 213/184

[58] Field of Search ..... 213/78, 79, 62 R, 62 A, 213/65, 69, 96, 97, 174, 182, 184; 105/261.1, 262, 263, 264, 269; 403/66, 71, 72, 78, 79, 82, 111, 164; 285/272, 278, 280, 367

[56] References Cited

U.S. PATENT DOCUMENTS 1,574,453 12/1925 Suarez ..... 213/75 R
2,862,731 4/1955 Hedden et al. ..... 285/272

FOREIGN PATENT DOCUMENTS 655183 8/1951 United Kingdom ..... 213/62 A
1194436 7/1970 United Kingdom ..... 285/278

*Primary Examiner*—Robert B. Reeves
*Assistant Examiner*—Dean J. Kramer
*Attorney, Agent, or Firm*—Edward J. Brosius; Charles E. Bouton

[57] ABSTRACT

A rotary railway drawbar coupler is provided which comprises two elongated shank members each having a convex butt surface at one end and a generally circular butt surface at the other end. The two elongated shanks are positioned between the two railway cars being coupled such that the circular butt ends are adjacent each other. A connecting collar surrounds the circular flange of which the circular butt surface is a part. Each elongated shank may have a longitudinal cavity extending inwardly from the circular butt surface to accommodate a cylindrical bar that extends between the elongated shanks.

11 Claims, 2 Drawing Sheets

ROTARY RAILWAY DRAWBAR COUPLER

BACKGROUND OF THE INVENTION

The present invention relates generally to railway couplers and, more particularly, to a rotary railway drawbar coupler.

Railway cars, especially freight cars, are connected by various means. One connection method is the rather well known use of independent coupler units which extend from either end of each railway car. Such coupler units most typically comprise a shank portion which extends into the railway car sill and is secured therein, with the coupler head extending outwardly from the railway car. Such coupler heads are usually referred to as automatic couplers and are adapted to connect to a similar coupler head protruding from another railway car.

Another method of connecting railway freight cars is the use of an integral drawbar one end of which would extend into a railway car sill to be secured therein, and the other end of which would extend into another railway car sill to be secured therein thereby coupling the two railway cars. Such drawbar couplers, or more simply drawbars, have the advantage over independent couplers of being lighter in weight, an important consideration in overall freight train fuel efficiency.

In certain freight car applications, it is desirable to be able to rotate one freight car while such car remains coupled to the adjoining cars in the freight train. Most typically, such rotary capability is desirable for freight gondola cars to unload coal or other solid granular material therefrom. The traditional drawbar coupler described above would not accommodate such car rotation. Such drawbars are set forth in U.S. Pat. No. 4,456,133, assigned to the assignee of the present invention.

BRIEF SUMMARY OF THE INVENTION

Accordingly, it is an object of the present invention to provide a drawbar coupler which permits the rotation of the railway cars to which its ends are connected.

The drawbar of the present invention comprises two identical elongated shank sections. One end of each shank has a convex butt surface and extends into and is received by known methods, most typically a keyslot and key arrangement, within the railway car sill. The other end of each elongated shank terminates in a circular butt section with a flat bearing surface that is adjacent to an identical flat bearing surface of the other elongated shank. When the circular butt sections of the elongated shanks are adjacent to each other, the shanks are aligned along their longitudinal centerlines.

Each elongated shank of the drawbar coupler is usually a cast steel unitary structure. To assure the maintenance of alignment between the elongated shanks, cylindrical cavities are provided which extend along the longitudinal axis of the elongated shank inwardly from an opening in the circular butt section of each shank. A cylindrical rod or tube, usually made of steel pipe, extends into the cylindrical cavity of each aligned shank. The cylindrical tube assures that the axial alignment is maintained between the elongated shanks.

Each circular butt section of each elongated shank is formed as the end surface of a flange which extends radially outward from the elongated, generally rectangular shank. The shape of such flange is circular to coincide with the circular butt section forming the flat end thereof. A connecting ring or collar is placed around the outer edge of the adjacent flanges of both elongated shanks. Such connecting collar most typically is comprised of two pieces each of a semicircular shape held together by traditional means such as bolting. In cross section the connecting collar is somewhat channel shaped on its internal surface to fit around the raised adjacent flanges of the two elongated shanks.

Accordingly, a rotary drawbar coupler is formed wherein each end of the appropriate elongated shank is held in a railway car center sill in a fixed relation to the center sill. However, upon the rotation of either of the so joined railway cars, the particular elongated shank connected to the center sill of the car being rotated likewise rotates with the car. The physical movement of the elongated shank is accommodated due to the circular butt section of the flange within the connecting collar readily rotating with respect to the adjacent circular butt section of the flange of the elongated shank connected to the railway car which is not being rotated.

DESCRIPTION OF THE PREFERRED EMBODIMENT

Figure 1:
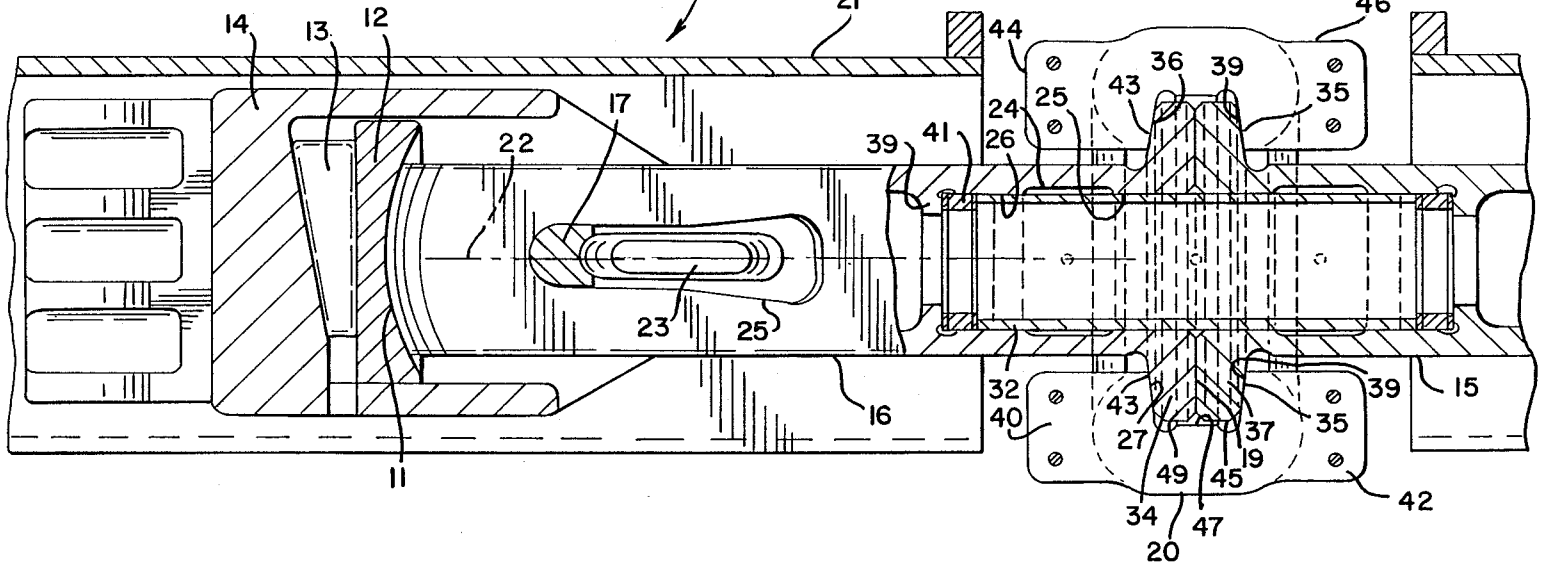
FIG. 1 is a side view, in partial cross section, of a rotary railway drawbar coupler in accordance with the present invention.
Figure 2:
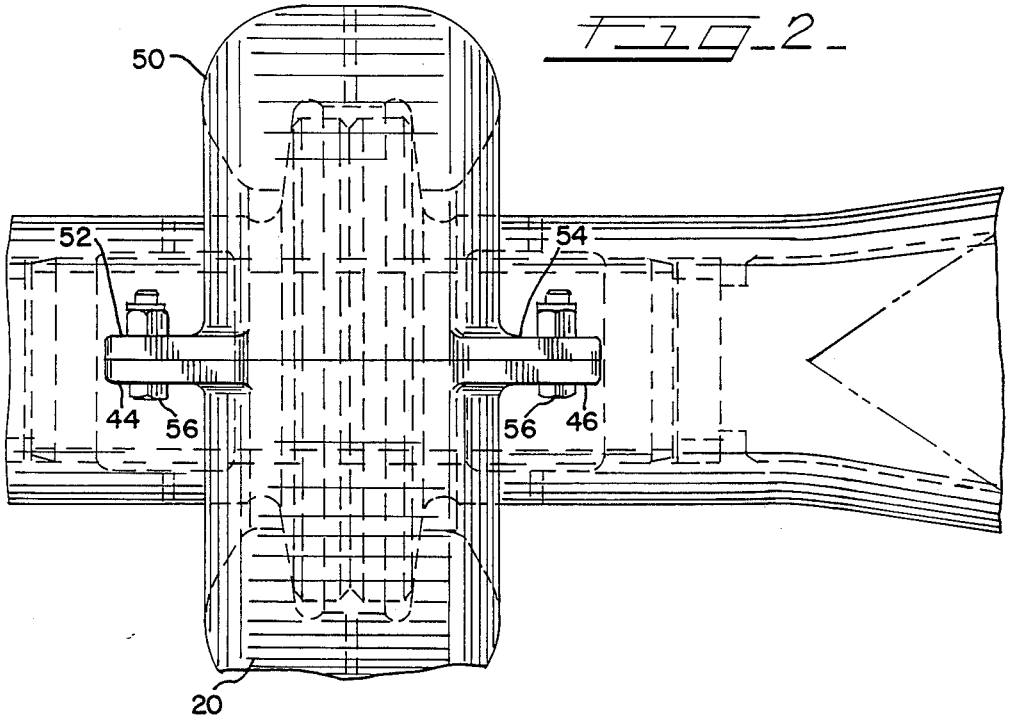
FIG. 2 is a top view of a portion of the rotary railway drawbar coupler of the present invention.
Figure 3:
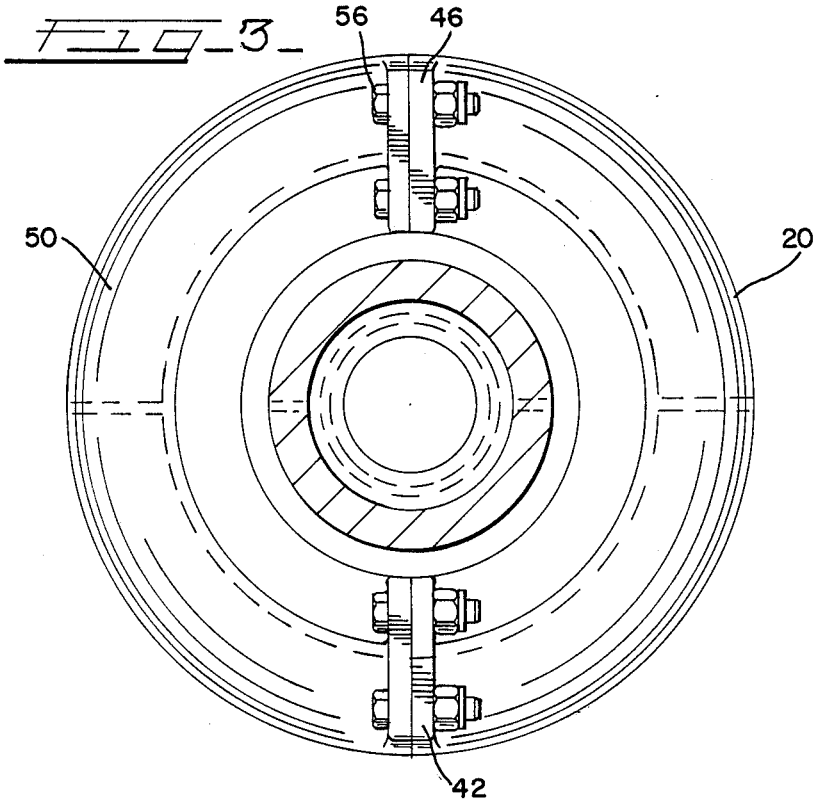
FIG. 3 is an end view of a portion of the rotary railway drawbar coupler of the present invention.

Referring now to FIGS. 1–3 of the drawings, a rotary railway drawbar coupler is shown generally at 10. Drawbar coupler 10 is comprised generally of two elongated shanks 15 and 16, that are aligned along their longitudinal axis 22. Elongated shanks 15 and 16 are identical, and accordingly only shank 16 will be described in detail. Shank 16 is a unitary cast steel construction having a generally rectangular configuration one end of which forms a convex butt section 11. The other end of shank 16 terminates in circular flange 34. Circular flange 34 extends radially outwardly from the rectangular width and height of shank 16, and includes a flat circular face 19. An elongated generally cylindrical cavity 24 exists within shank 16 extending therein from an opening in circular flange 34. Guiding surfaces 25 and 26 are of a reduced diameter and act to form supports for cylindrical rod 32 which extends with one end thereof into cavity 24, with the other end thereof extending into a similar cavity in shank 15. Cylindrical rod 32 is usually a steel pipe. The ends of cylindrical rod 32 terminate against an elastomeric cylindrical collar 41 with a thrust bearing on at least one end. Collar 41 itself abuts internal stops 39 extending within shank 16. Elongated shank 15 includes a convex butt end similar to butt end 11 of shank 16, but this end of shank 15 is not shown in FIG. 1. Elongated shank 15 has another end which terminates in circular flange 37. Circular flange 37 extends radially outwardly from the height and width of the rectangular dimension of shank 15 in a manner identical to flange 34 of shank 16, as shanks 15 and 16 are themselves identical. Further, flange 37 of shank 15 includes flat face 27 which is adjacent to and, under certain conditions, abuts-flat face 19 of flange 34 of shank 16.

Butt end 11 of shank 16 extends into a railway car sill 21. Shank 16 includes a keyhole opening 25 through which flat elongated key 23 extends thereby locking shank 16 to car sill 21. Key (bearing) block 17 is contained in the key hole opening 25 and has a cylindrical forward surface which is in contact with the back surface of key 23 and which has a convex rear surface that is horizontally concentric with butt end 11. Butt end 11 of shank 16 contacts a concave surface of follower block 12. Wedge 13 acts between the front surface of pocket 14 and the rear surface of follower block 12. Wedge 13 acts to provide a slackless feature to the drawbar coupler. It is not essential for the rotary drawbar coupler 10 to include such slackless feature, but it is desirable.

A connecting collar comprising half sections 20 and 50 surrounds adjacent flanges 34 and 37 of elongated shanks 16 and 15, respectively. Connecting collar section 20 is identical to section 50 and generally comprises a single steel piece having four extended flanges 40, 42, 44 and 46 along a planar face thereof. As seen in FIG. 2, extension flanges 44 and 46 of connecting collar 20 are joined to corresponding extension flanges 52 and 54 of connecting collar 50 by bolts 56.

Connecting collar 20 has an internal indentation giving it a generally channel shape. Internal walls 36 and 39 are sloped and are adjacent correspondingly sloped surfaces 43 and 35 of flanges 34 and 37, respectively. Space is provided between the radial outermost edge 49 and 45 of flanges 34 and 37, and the inner edge 47 of the channel opening in connecting collar 20. Such spacing is desirable to permit the rotation of either shank 15 or 16 within connecting collar 20. It may be desirable to provide a grease fitting through either collar 20 or collar 50 to permit a lubricant to be injected into the space between flanges 34 and 37 and collars 20 and 50.

What is claimed is:

1. A rotary railway drawbar coupler comprising a first elongated shank having a convex butt surface at one end thereof, a generally circular butt at the other end of said first elongated shank, a generally cylindrical cavity extending inwardly form said circular butt of said first elongated shank, a generally circular flange extending radially outwardly from said first elongated shank at said circular butt and a generally flat face on said circular butt adjacent said generally circular flange, a second elongated shank having a convex butt surface at one end thereof, a generally circular butt at the other end of said second elongated shank, a generally cylindrical cavity extending inwardly from said circular butt of said second elongated shank, a generally circular flange extending radially outwardly from said second elongated shank at said circular butt and a generally flat face on said circular butt adjacent said generally circular flange, a generally cylindrical bar extending between the axially aligned cylindrical cavities of said first and said second elongated shanks, and a generally circular connecting means joining the outsides of the circular flanges of said first and second elongated shanks, said generally circular connecting means comprises two half rings joined together to form a ring of a generally channel shaped cross section, said ring having internal sides contacting adjacent sloped surface of said generally circular flanges of said first and second elongated shanks.

2. The rotary railway drawbar coupler of claim 1 wherein said generally circular flanges of said first and said second elongated shanks include a radially outer surface that is generally parallel to the longitudinal axis of the elongated shanks and generally perpendicular to the generally flat faces on said circular butts, and said generally circular flanges also include sloped faces adjacent said radially outer surface.

3. The rotary railway drawbar coupler of claim 2 wherein said generally circular connecting means comprises a ring having inner sloped edges adjacent said sloped faces of said generally circular flanges.

4. The rotary railway drawbar coupler of claim 1 wherein said first elongated shank and said second elongated shank are rotatable with respect to each other.

5. A rotary railway drawbar coupler comprising an elongated first shank, a convex butt at one end of said first shank and a generally flat circular bearing surface at the other end of said first shank, a raised flange extending radially outward from said first shank to form said bearing surface, an elongated second shank, a convex butt at one end of said second shank and a generally flat circular bearing surface at the other end of said second shank, a raised flange extending radially outward from said second shank to form said bearing surface, said first shank and said second shank being generally axially aligned with the generally flat circular bearing surfaces of each of said shanks being adjacent to each other, and a connecting collar extending around the adjacent raised flanges of said first and second shanks, said connecting collar comprising two half-ring sections that are joined together around said raised flanges of said first and second shanks.

6. The rotary railway drawbar coupler of claim 5 wherein said raised flanges of said first and said second shanks include a radial edge surface adjacent and generally perpendicular to said bearing surfaces and a sloped surface adjacent said radial edge.

7. The rotary railway drawbar coupler of claim 5 wherein said connecting collar comprises a bracket having a generally channel shape in cross section and having inner side edges adjacent said raised flanges of said first and second shanks.

8. The rotary railway drawbar coupler of claim 5 wherein each of said elongated first and second shanks is generally rectangular in cross section.

9. The rotary railway drawbar coupler of claim 5 wherein each of said first and second shanks has an elongated, generally cylindrical cavity therein extending inwardly from an opening in the bearing surface thereof.

10. The rotary railway drawbar coupler of claim 9 further concluding a generally cylindrical bar that extends into each generally cylindrical cavity in each of said shanks.

11. A rotary railway drawbar coupler comprising a first elongated shank having a convex butt surface at one end thereof, a generally circular butt at the other end of said first elongated shank, a generally cylindrical cavity extending inwardly from said circular butt of said first elongate shank, a generally circular flange extending radially outwardly from said first elongated shank at said circular butt and a generally flat face on said circular butt adjacent said generally circular flange, a second elongated shank having a convex butt surface at one end thereof, a generally circular butt at the other end of said second elongated shank, a generally cylindrical cavity extending inwardly from said circular butt of said second elongated shank, a generally circular flange extending radially outwardly from said second elongated shank at said circular butt and a generally flat face on said circular butt adjacent said generally circular flange, a generally cylindrical bar extending between the axially aligned cylindrical cavities of said first and said second elongated shanks, and a generally circular connecting means joining the outsides of the circular flanges of said first and second elongated shanks, said generally circular flanges of said first and second elongated shanks contacting each other along said generally flat faces on said circular butts.

* * * * *